US010407928B2

(12) United States Patent
Lafontaine

(10) Patent No.: US 10,407,928 B2
(45) Date of Patent: Sep. 10, 2019

(54) POOL SKIMMER FACEPLATE COVER WITH INTEGRATED LIGHT

(71) Applicant: CANADIAN PLASTICS INC., LaSalle (CA)

(72) Inventor: Robert Lafontaine, Boucherville (CA)

(73) Assignee: Canadian Plastics Inc., Lasalle (CA)

( * ) Notice: Subject to any disclaimer, the term of this patent is extended or adjusted under 35 U.S.C. 154(b) by 0 days.

(21) Appl. No.: 15/670,075

(22) Filed: Aug. 7, 2017

(65) Prior Publication Data

US 2017/0335585 A1 Nov. 23, 2017

Related U.S. Application Data

(63) Continuation-in-part of application No. 14/954,451, filed on Nov. 30, 2015, now abandoned.

(51) Int. Cl.

| | |
|---|---|
| ***E04H 4/12*** | (2006.01) |
| ***E04H 4/14*** | (2006.01) |
| *F21W 131/401* | (2006.01) |

(52) U.S. Cl.

CPC ..... *E04H 4/1272* (2013.01); *E04H 4/148* (2013.01); *F21W 2131/401* (2013.01)

(58) Field of Classification Search

CPC . E04H 4/1272; E04H 4/148; F21W 2131/401
USPC ..... 210/167.1
See application file for complete search history.

(56) References Cited

U.S. PATENT DOCUMENTS

| | | | | |
|---|---|---|---|---|
| 3,706,379 | A * | 12/1972 | Erlich | E04H 4/1272 210/123 |
| 7,451,500 | B2 * | 11/2008 | Baker, Jr. | E04H 4/1272 4/496 |
| 2003/0048632 | A1 * | 3/2003 | Archer | E04H 4/148 362/101 |
| 2014/0362578 | A1 * | 12/2014 | Dong | F21V 31/005 362/267 |

* cited by examiner

*Primary Examiner* — Fred Prince
(74) *Attorney, Agent, or Firm* — Mila Shvartsman

(57) ABSTRACT

The present invention is a modular pool skimmer faceplate cover with a pre-wired integrated underwater light. The faceplate cover of the present invention clips onto a faceplate of any pool skimmer inside a swimming pool. The faceplate cover is provided with a cavity below the faceplate cover's mouth that accommodates a light source element, and this light source element connects to a low-voltage power supply. The light source element can be a LED, and be located below or around the faceplate cover's mouth.

19 Claims, 7 Drawing Sheets

POOL SKIMMER FACEPLATE COVER WITH INTEGRATED LIGHT

This application is continuation-in-part of regular application Ser. No. 14/954,451 filed on Nov. 30, 2015. The present invention relates to a swimming pool skimmer faceplate cover with an integrated underwater light. All swimming pools require a skimmer apparatus to remove floating debris such as leaves and insects. A skimmer is standard equipment in every pool, and every skimmer has a faceplate. The present invention is an accessory for a skimmer faceplate, namely a faceplate cover that adds advantageous and aesthetic underwater illumination. It is easy to install, and does not require for a pool to be drained for installation.

Underwater illumination is a desirable feature of any swimming pool. It adds value, usability and aesthetics. Most underwater light systems need major modifications to a pool's infrastructure, including draining the pool, drilling holes in the pool wall and installing complicated wiring assemblies adapted for underwater use.

The present invention combines both a skimmer and underwater illumination in one simple, unitary faceplate cover without the need to drain the pool and drill an extra hole in the swimming pool wall for a light. It also eliminates the need to install complicated, dangerous power wiring for a light. Any skimmer faceplate can be easily equipped with the present invention, permitting a swimming pool user to install underwater illumination quickly and easily.

BACKGROUND

There exists U.S. Pat. No. 5,207,499 for INTEGRAL LIGHT AND LIQUID CIRCULATION FITTING. There is also known U.S. Pat. No. 7,188,378 for SWIMMING POOL IMMERSED LIGHT FIXTURE. Both these patents are for a return fitting, not a skimmer. A return fitting is the inlet for the water that is returned into the pool through a pump to promote a circulatory current to move debris into the pool a skimmer.

There also U.S. Pat. No. 3,706,379 to Erlich for SKIMMER ASSEMBLY HAVING AN AUTOMATIC SHUT-OFF WEIR disclosing a skimmer faceplate with an integrated light. This patent is very different from the present invention due to the fact the Erlich invention is a skimmer faceplate, not a faceplate cover. The Erlich design requires an opening to be cut in the pool wall for a light fixture, with sophisticated electrical connections pre-installed to power the light. In use, installation of the Erlich design on a pool wall will severely weaken the wall due to the surface area of wall that must be removed for proper installation, thus heightening the risk of catastrophic failure when the pool is filled with water. The pressure of the water, not supported by a wall that was removed to install the Erlich design, will rupture the wall where the Erlich design is mounted, thereby destroying the pool. The Erlich design is also prohibitively expensive to manufacture out of plastic due to the configuration of its elements.

OBJECT OF THE INVENTION

The present invention permits a swimming pool user to install underwater illumination without drilling holes in the pool wall or installing wiring. The present invention, being a faceplate cover, is snapped onto a typical swimming pool skimmer faceplate. The faceplate cover of the present invention incorporates a light source below the skimmer's mouth.

In other embodiments, the light could be placed on either side of the faceplate cover, on both sides of the faceplate cover, or on all three sides of the faceplate cover.

The faceplate cover of the present invention has all necessary electric wiring built in and pre-wired, so that the user simply plugs the wiring harness into a power supply outside of the pool wall near to the skimmer, and the swimming pool instantly has underwater illumination. In one alternative, the user can drill a hole in the skimmer's body above the water line to feed the wire. In another alternative, if the user does not want to drill a hole in the skimmer, he can remove a pre-scored notch from the faceplate cover to accommodate the wire over the top edge of the faceplate cover.

The present invention is an elegant, slim and streamlined alternative to an otherwise expensive and complicated swimming pool addition. Since no holes need to be drilled in the pool wall, leaks are averted. Considering all wiring is built into the faceplate cover of the invention, the risk of electrocution due to faulty wiring is minimized. Changing the LED lights is very easy, as the LED holder is part of the skimmer's faceplate cover and not hard-wired into the pool wall infrastructure.

DETAILED DESCRIPTION OF THE PREFERRED EMBODIMENT

The present invention allows a pool to be fitted with underwater lighting for a fraction of the usual cost, and with almost no tools. No changes are necessary to the pool's structure, no electrical wiring needs to be installed, and fitting the underwater lights can be accomplished within minutes.

The present invention uses a feature common to all swimming pools: the skimmer. The present invention comprises a faceplate cover attached to a regular faceplate, wherein said faceplate cover contains an integrated light and hard-wired for low voltage electricity. Once plugged in, the light incorporated into the present faceplate cover acts as an underwater illumination, adding value and usability to any pool.

Figure 1:
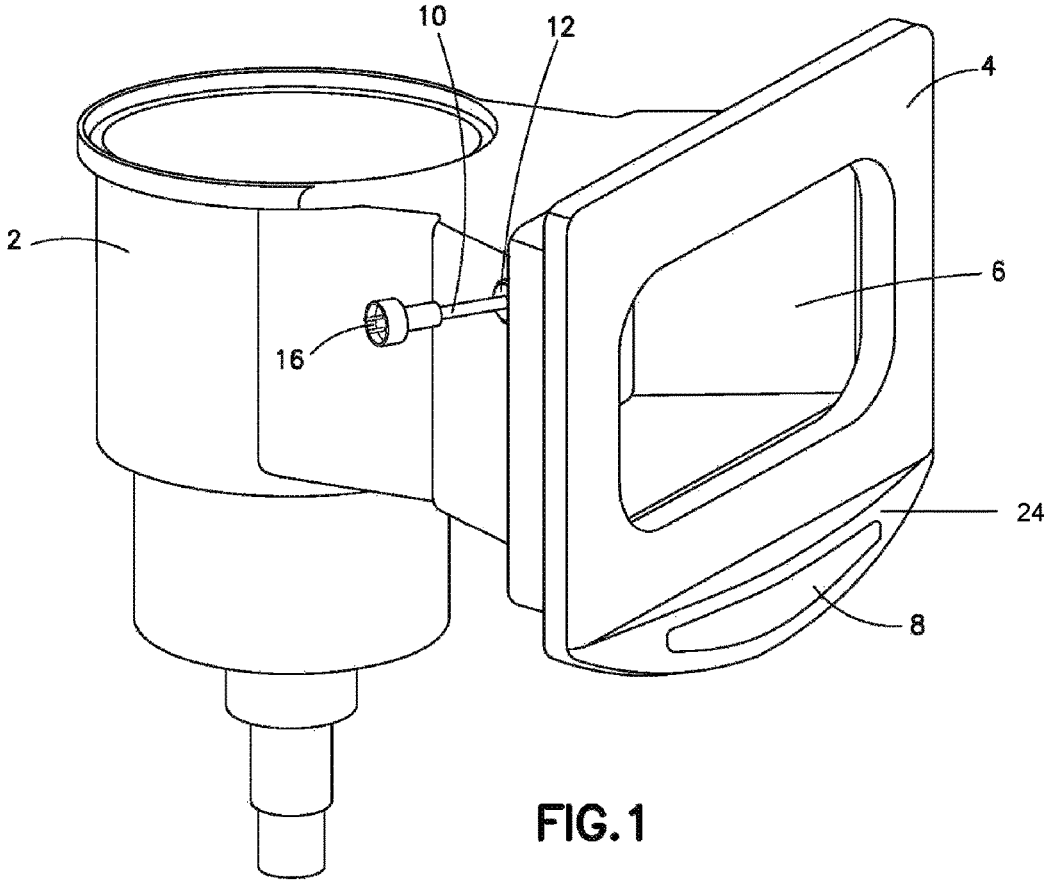
FIG. 1 shows a perspective view of the present invention installed on a pool skimmer.

Referring now to drawings, the preferred embodiment is described on FIGS. 1-10. FIG. 1 shows the present invention, being a skimmer faceplate cover 4, attached to an industry-standard skimmer 2. Faceplate cover 4 is clipped by means of clips 5 (seen on FIGS. 8 and 9) onto skimmer 2's faceplate 3, illustrated on FIG. 10. Faceplate cover 4 comprises a substantially square, flat plate, incorporating an integrated pre-wired source of light such as a LED light 8 at the bottom. The bottom edge of faceplate cover 4 is of semi-circular configuration and comprises a bracket 24 for holding light 8. Faceplate cover 4 also comprises a mouth 6 of substantially rectangular configuration with rounded edges. Mouth 6 is located in the upper portion of faceplate cover 4. Skimmer 2 comprises a through-fitting 12 accommodating wire 10, with plug 16 being on the distal end of wire 12. As seen on FIG. 4, a cavity 22 is formed in bracket 24 for holding light and to accommodate light (LED) element 8. A pool wall 18 (not shown) separates faceplate 3 and faceplate cover 4, located inside the pool, from skimmer 2, located outside the pool. Through-fitting 12 is located inside skimmer 2 body, permitting wire 10 to traverse from inside to outside of skimmer 2. LED light 8 is located at bottom of faceplate cover 4 inside bracket for holding light.

Figure 2:
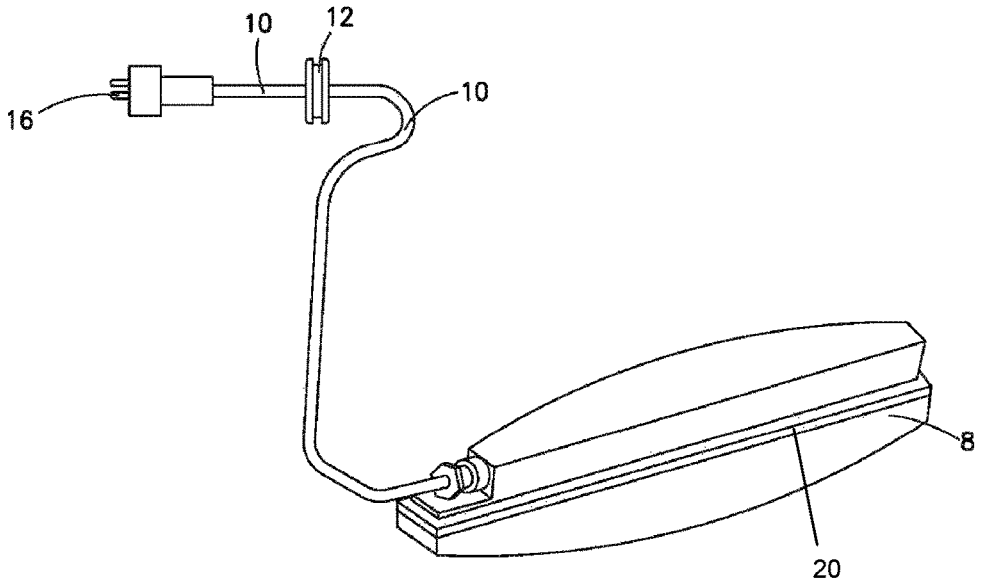
FIG. 2 is an isolated view of the light system of the present invention
Figure 7:
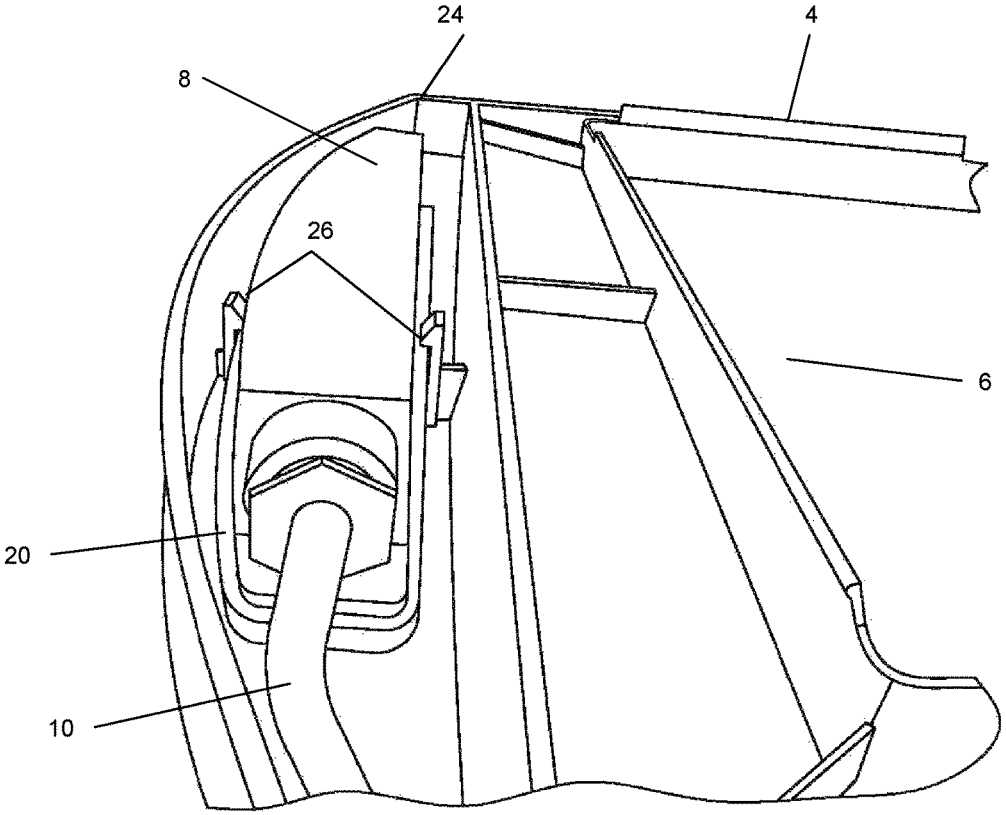
FIG. 7 shows a perspective back view as on FIG. 6 showing light element completely inserted into a cavity in faceplate.

FIG. 2 shows the electrical system alone, comprising LED light 8 connected by wire 10 to plug 16, going through through-fitting 12. LED Light 8 is of substantially elongated rectangular configuration, with the bottom edge being semi-circular. FIG. 7 shows how the present invention is installed inside a pool, with wall 18 separating faceplate cover 4 mounted on faceplate 3 from skimmer 2. Wire 10 is fed through through-fitting 12, discreetly running inside faceplate cover 4 to LED light 8. Wire 10 terminates with plug 16, which connects to a power supply (not shown). A hole must be drilled in skimmer 2 to accommodate through-fitting 12 to prevent leaks from inside the pool to the outside, yet let wire 10 pass through. As shown on FIG. 1, through-fitting 12 leads wire 10 from inside skimmer 2 to outside skimmer 2. Faceplate cover 4 accommodates LED light 8 in an aesthetic and streamlined manner. LED light 8 has an edge 20 that serves as retaining means when light 8 is installed in cavity 22.

Figure 3:
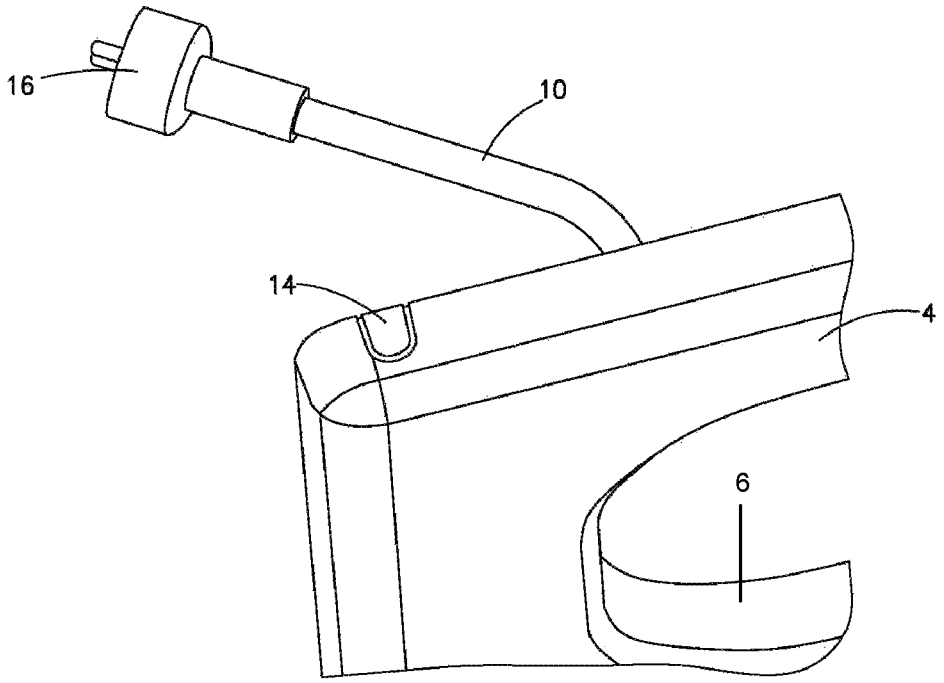
FIG. 3 is a fragmental top perspective view showing wire-fitting notch.

FIG. 3 demonstrates an alternative embodiment wherein no holes have to be drilled in skimmer 2 to accommodate through-fitting 12. User simply punches out wire-fitting notch 14 located in the upper rib of faceplate cover 4, and feeds wire 10 through the resulting opening.

Figure 4:
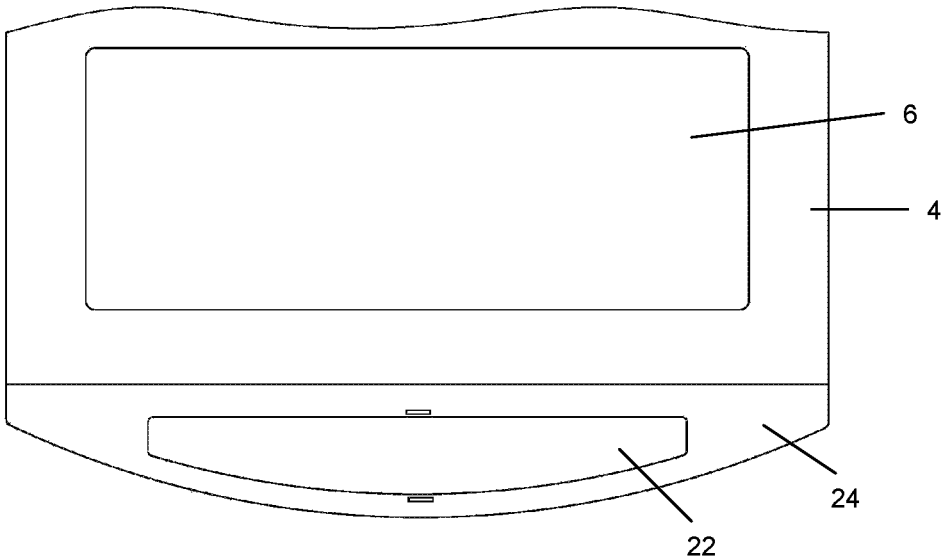
FIG. 4 is a fragmental front view of a faceplate according to the present invention.

FIG. 4 shows a faceplate cover 4 provided with cavity 22 made in bracket 24 for holding light to accommodate light 8, and has a configuration complimentary to the shape of light 8.

Figure 5:
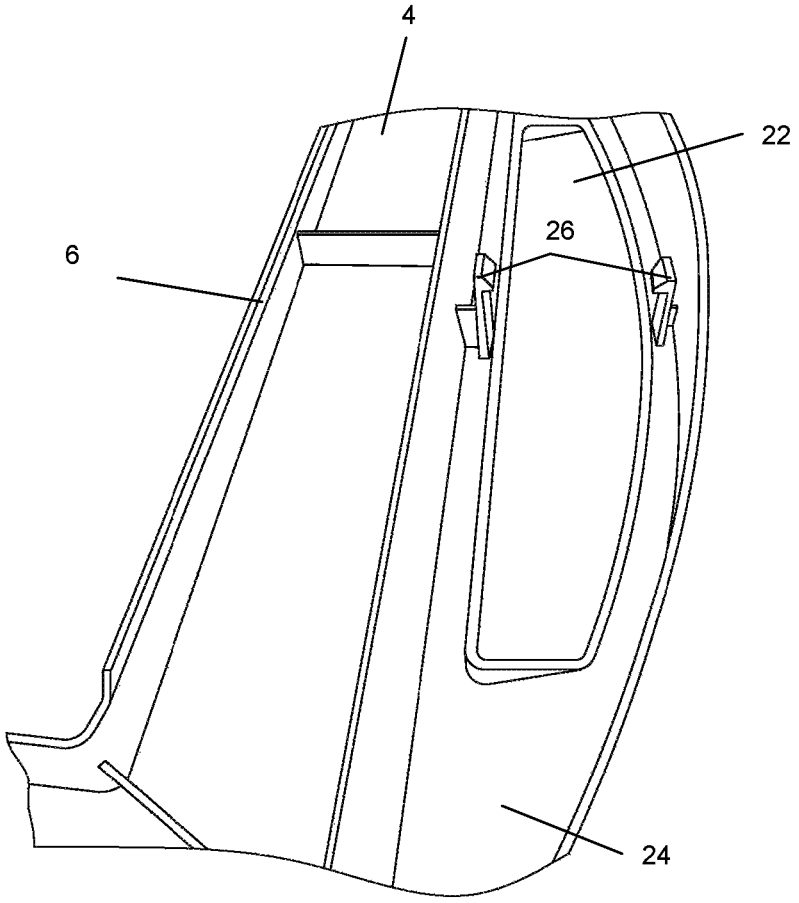
FIG. 5 is a fragmental perspective back view of faceplate of FIG. 4 showing barbed prongs of the present invention.

FIG. 5 is a back view of faceplate cover 4 showing at least two barbed prongs 26 extending outwardly from edges of cavity 22. Prongs 26 are proved to securely hold the light element 8 by edge 20 within cavity 22.

Figure 6:
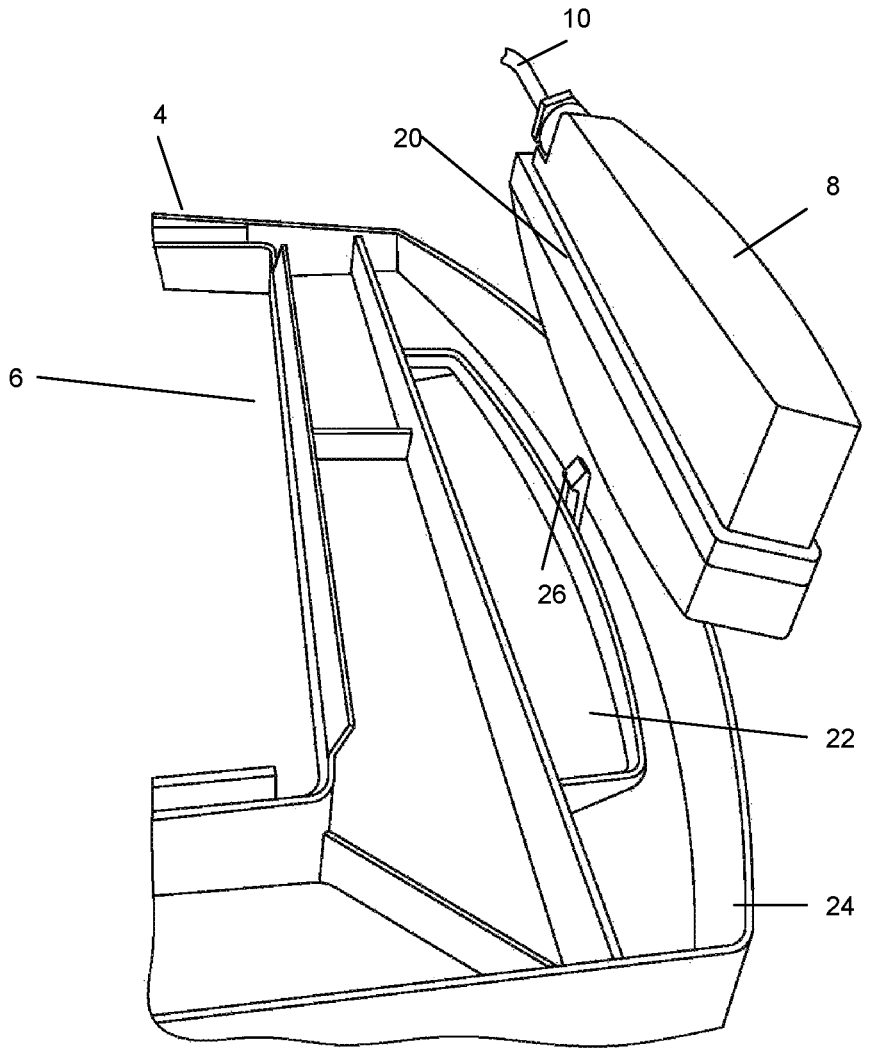
FIG. 6 is a perspective back view of FIG. 5 showing light (LED) element before it is inserted into faceplate.

FIG. 6 is the back view of faceplate cover 4, as on FIG. 5, showing light 8 being inserted into cavity 22. This figure clearly shows edge 20 formed around light 8 and provided to be held by corresponding barbed prongs 26 shown on FIG. 5.

FIG. 7 shows back portion of faceplate cover 4 where light 8 is completely inserted within cavity 22, and barbed prongs 26 retain edge 20 of light 8 in a secure position.

Figure 8:
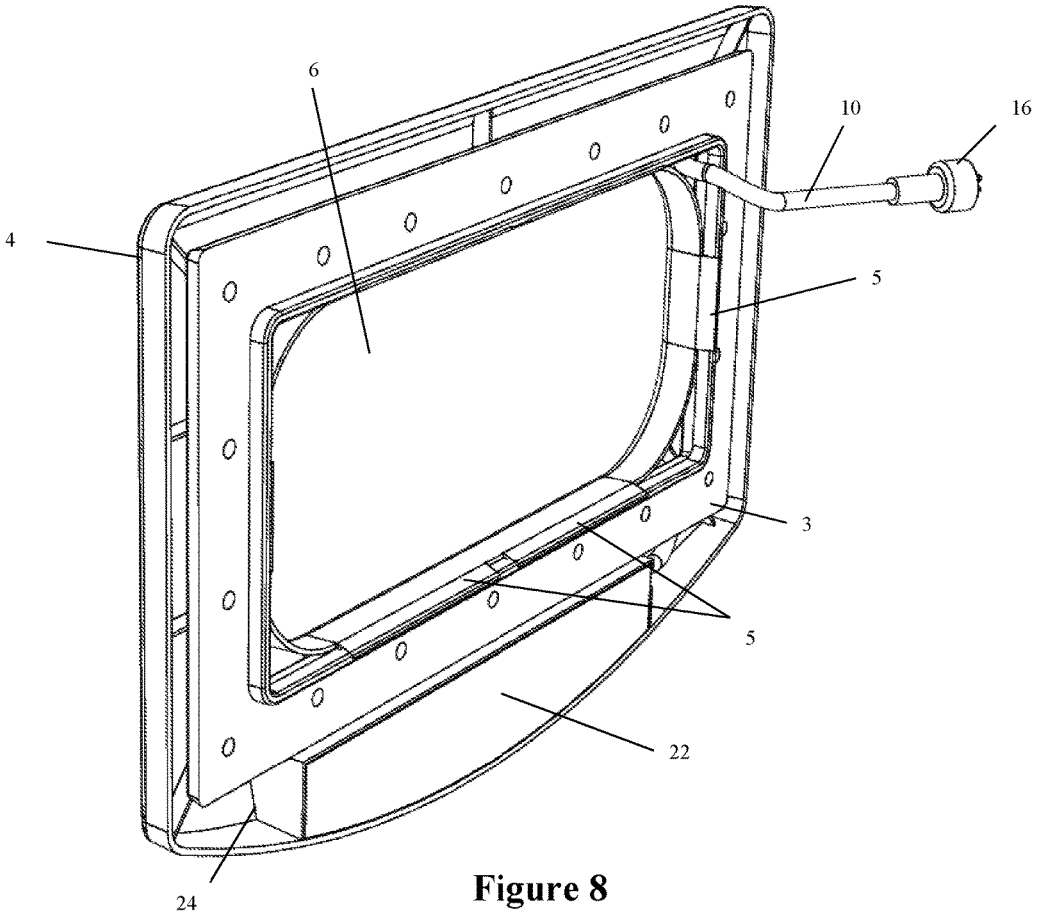
FIG. 8 shows an assembled rear view of faceplate cover attached to faceplate of the present invention.

FIG. 8 shows faceplate cover 4 of the present invention attached to faceplate 3 without using any screws. Instead, resilient clips 5 snap into place as the user pushes faceplate 4 onto faceplate 3, thus immobilizing faceplate cover 4 on faceplate 3.

Figure 9:
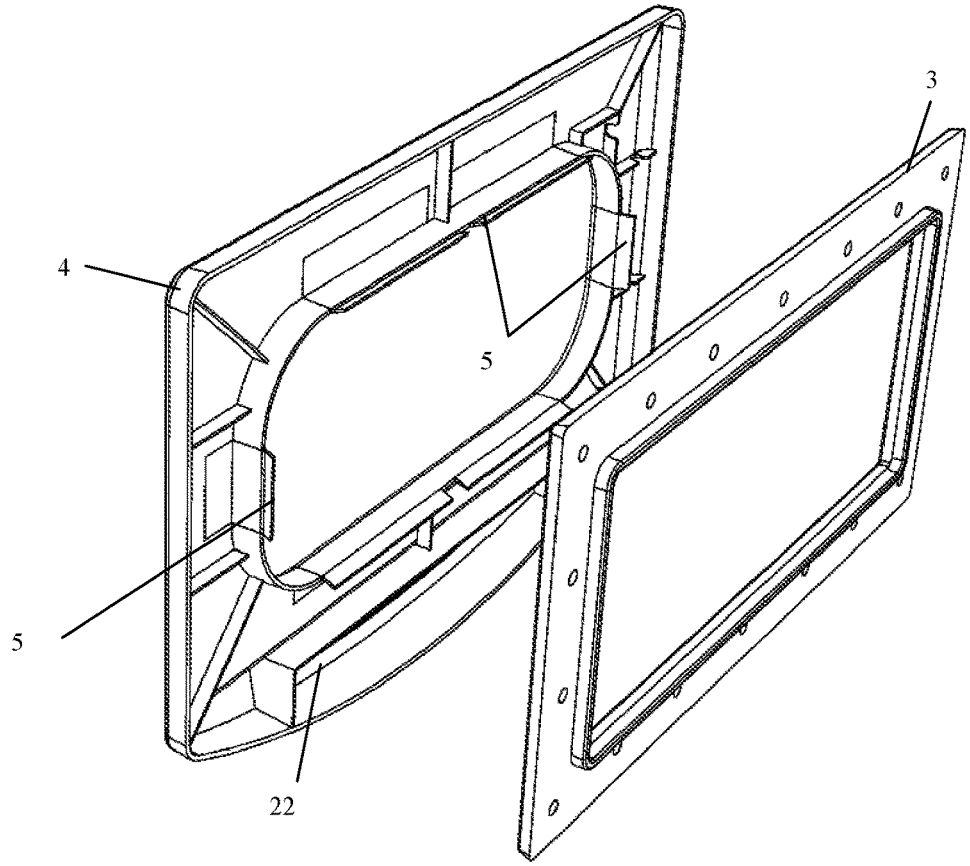
FIG. 9 shows a rear disassembled view showing faceplate and faceplate cover of the present invention.

FIG. 9 shows a disassembled view of faceplate 3 and faceplate cover 4 of the present invention. The biggest advantage of the present invention that faceplate cover 4 of the present invention is mounted on faceplate 3 by means of clips 5 formed along inner perimeter of mouth 6 without the need of any screws or similar elements which eliminates problems of drilling extra holes inside the pool's wall. This innovative faceplate cover can be easily attached to any known industry-standard skimmer faceplate.

Figure 10:
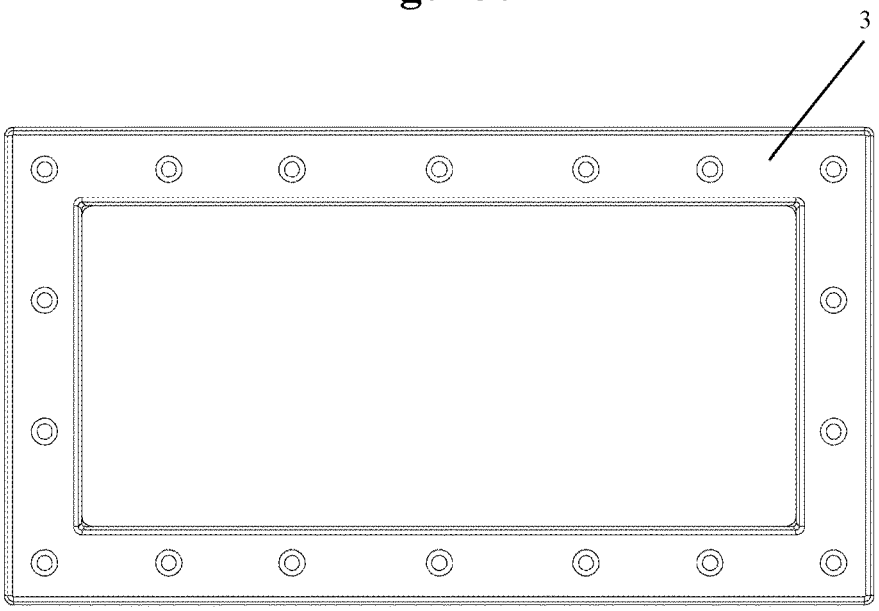
FIG. 10 shows a faceplate of the present invention mounted on an inside wall of the pool.

FIG. 10 shows a typical, industry-standard faceplate 3 as mounted on an inside wall of a swimming pool.

In operation, in the preferred embodiment, user snaps light 8 into its cavity 22 inside faceplate cover 4, clips wire 10 along faceplate cover 4's inside edge, drills a hole in skimmer 2's body, feeds wire 10 through the resulting hole, installs through-fitting 12, and plugs in LED light 8's plug 16 into a low voltage power supply apparatus (not shown). In another embodiment shown on FIG. 3, rather than drilling a hole in skimmer 2's body, user removes wire-fitting notch 14 in faceplate cover 4 and feeds wire 10 through the resulting cavity.

Referring to FIG. 9, user attaches faceplate cover 4 onto faceplate 3 with clips 5 so that faceplate cover 4 is immobilized on faceplate 4 as seen on FIG. 8.

A power converter to convert household current (110V, etc.) to 12-volt is provided to the user with the invention. Other power transmission means are possible.

The invention claimed is:

1. A unitary modular faceplate cover for a swimming pool skimmer comprising
- a faceplate cover,
  - said faceplate cover is adapted to be releasably mounted over
  - a faceplate mounted on a wall of said pool;
- said faceplate cover comprises
  - a mouth provided with
  - a number of clips extending from inner wall of said mouth and adapted to releasably mount said faceplate cover on said faceplate;
- said faceplate cover is adapted to accommodate
  - an independent pre-wired light source element incorporated within said faceplate cover,
  - said light source element is provided with an electrical means adapted to connect said light source element with a low voltage power supply means having a voltage between 12 and 24 volts, and
- wherein said faceplate cover is adapted to be mounted on any known pool skimmer faceplate.

2. A unitary modular faceplate cover for a pool skimmer according to claim 1, wherein said faceplate cover is provided with a cavity adapted to accommodate said light source element.

3. A unitary modular faceplate cover for a pool skimmer according to claim 2, wherein said cavity is located in a lower part of said faceplate cover below said mouth.

4. A unitary modular faceplate cover for a pool skimmer according to claim 3, wherein said faceplate cover has a substantially rectangular configuration and a bottom portion of said faceplate cover has a semi-circular configuration, said cavity of said faceplate cover has an elongated configuration, wherein a bottom portion of said cavity has a semi-circular configuration and wherein said light source element also has an elongated configuration with a bottom portion having a corresponding semi-circular configuration to accommodate said light source element within said cavity.

5. A unitary modular faceplate cover for a pool skimmer according to claim 4, wherein said cavity of said faceplate cover is provided with at least two locking elements, said locking elements are adapted to securely hold said light source element within said cavity.

6. A unitary modular faceplate cover for a pool skimmer according to claim 5, wherein said locking elements extend outwardly from an inner edge of said cavity and wherein said light source element is provided with a corresponding groove formed around outer walls of said light source element, said locking elements are adapted to securely lock said light source element within said cavity formed in said faceplate cover by means of said groove.

7. A unitary modular faceplate cover for a pool skimmer according to claim 1, wherein said electrical means is a wire integrally connected to said light source element, said wire is of sufficient length to connect said light source element from inside of said faceplate cover to said outside low voltage power supply.

8. A unitary modular faceplate cover for a pool skimmer according to claim 7, wherein said wire of said light source element is connected to said power supply by means of a hole drilled in said skimmer, said wire is provided with a through-fitting.

9. A unitary modular faceplate cover for a pool skimmer according to claim 7, wherein said faceplate cover is provided with a wire-fitting notch formed on said faceplate cover, said notch provided to feed said wire from said faceplate cover through a resulting opening.

10. A unitary modular faceplate cover for a pool skimmer according to claim 1, wherein said light source element is a LED light.

11. A unitary modular faceplate cover in combination with a pool skimmer comprising:

a faceplate cover adapted to fit over a faceplate of said skimmer, wherein said faceplate is fixed on inner wall of said pool;

said faceplate cover is provided with a number of clips extending from a mouth of said faceplate cover, said faceplate cover is adapted to be releasably mounted over said faceplate;

said faceplate cover is adapted to accommodate an independent pre-wired light source element incorporated within said faceplate cover, said light source element is provided with an electrical means adapted to connect said light source element with a low voltage power supply means, wherein said low voltage is between 12 and 24 volts, said faceplate cover is provided with a cavity adapted to accommodate said light source element.

12. A unitary modular faceplate cover in combination with a pool skimmer according to claim 11, wherein said cavity is located in a lower part of said faceplate cover below said mouth.

13. A unitary modular faceplate cover in combination with a pool skimmer according to claim 12, wherein said faceplate cover has a substantially rectangular configuration and a bottom portion of said faceplate cover has a semi-circular configuration, said cavity of said faceplate cover has an elongated configuration, wherein a bottom portion of said cavity has a semi-circular configuration and wherein said light source element also has an elongated configuration with a bottom portion having a corresponding semi-circular configuration to accommodate said light source element within said cavity.

14. A unitary modular faceplate cover in combination with a pool skimmer according to claim 13, wherein said cavity of said faceplate cover is provided with at least two locking elements, said locking elements are adapted to securely hold said light source element within said cavity.

15. A unitary modular faceplate cover in combination with a pool skimmer according to claim 14, wherein said locking elements extend outwardly from an inner edge of said cavity and wherein said light source element is provided with a corresponding groove formed around outer walls of said light source element, said locking elements are adapted to securely lock said light source element within said cavity formed in said faceplate cover by means of said groove.

16. A unitary modular faceplate cover in combination with a pool skimmer according to claim 11, wherein said electrical means is a wire integrally connected to said light source element, said wire is of a sufficient length to connect said light source element from inside of said faceplate cover to said outside low voltage power supply.

17. A unitary modular faceplate cover in combination with a pool skimmer according to claim 16, wherein said wire of said light source element is connected to said power supply by means of a hole drilled in said skimmer, said wire is provided with a through-fitting.

18. A unitary modular faceplate cover in combination with a pool skimmer according to claim 16, wherein said faceplate cover is provided with a wire-fitting notch formed on said faceplate cover, said notch provided to feed said wire from said faceplate cover through a resulting opening.

19. A unitary modular faceplate cover in combination with a pool skimmer according to claim 11, wherein said light source element is a LED light.

* * * * *